United States Patent [19]

Riihimäki

[11] Patent Number: 4,927,534

[45] Date of Patent: May 22, 1990

[54] SCREEN SYSTEM

[75] Inventor: Antti Riihimäki, Noormarkku, Finland

[73] Assignee: Rauma-Repola Oy, Finland

[21] Appl. No.: 321,311

[22] Filed: Mar. 10, 1989

[30] Foreign Application Priority Data

Mar. 30, 1988 [FI] Finland ..... 881494

[51] Int. Cl.[5] ..... B07B 1/46

[52] U.S. Cl. ..... 209/315; 209/255; 209/259; 209/317; 209/933

[58] Field of Search ..... 209/315, 317, 255, 256, 209/257, 258, 259, 353, 672, 680, 682, 933

[56] References Cited

U.S. PATENT DOCUMENTS

| | | | |
|---|---|---|---|
| 1,189,167 | 6/1916 | Parker | 209/682 X |
| 2,252,701 | 8/1941 | Copeman | 209/255 |
| 4,430,210 | 2/1984 | Tuuha | 209/234 |
| 4,647,370 | 3/1987 | Tuuha | 209/315 |

FOREIGN PATENT DOCUMENTS

| | | | |
|---|---|---|---|
| 207166 | 6/1959 | Fed. Rep. of Germany | 209/682 |
| 51775 | 12/1976 | Finland . | |
| 65925 | 4/1984 | Finland . | |
| 68988 | 8/1985 | Finland . | |
| 886996 | 12/1981 | U.S.S.R. | 209/258 |
| 13359 | of 1915 | United Kingdom | 209/255 |

*Primary Examiner*—Donald T. Hajec

*Attorney, Agent, or Firm*—Burns, Doane, Swecker & Mathis

[57] ABSTRACT

A screen system intended for the screening of wood chips, comprising one or several screening faces (2,3) placed one above the other as well as a bottom face (4) placed underneath said screening faces. The screening faces (2,3) are connected to members (10) that produce the screening movement. The bottom face (4) is made of a flexible material and is displaceable relative its support structure (6) so that the bottom face is deformed to prevent the adherence of materials thereto. Most appropriately, the width of the bottom face (5) is larger than the distance between the support structures (6) placed at its sides, whereby the middle portion of the bottom face (5) is hanging down lower than its sides.

3 Claims, 2 Drawing Sheets

SCREEN SYSTEM

BACKGROUND OF THE INVENTION

1. Field of the Invention

The present invention concerns a screen system intended for the screening of wood chips, comprising one or several screening faces placed one above the other as well as a bottom face placed underneath said screening faces, the screening faces being connected to members that produce the screening movement.

2. Description of Related Art

Prior-art screens intended for the screening of wood chips have been described in the Finnish Patents 51,775, 65,925 and 68,988. These screens comprise three screening planes placed one above the other, wherein the perforations become smaller when moving from the top towards the bottom, as well as a solid plane placed underneath the screening planes. The screen basket may be an integrated construction, or it may be divided into two blocks of two planes each. In both cases, however, the solid bottom plane is a part of the screen basket and moves along with the screening planes proper as they perform the screening movement.

When wood chips are being screened, the finest, dust-like fraction falls to the bottom plane. The bottom plane is more problematic than the perforated screen plate planes proper, on which the coarser material moves. Under certain circumstances, a deposit is formed on the bottom plane, which may block the whole space between the bottom plane and the screen plate placed above the bottom plane. The blocking causes interruptions in the screening. Moreover, the increase in the swinging mass caused by the deposits strains the construction of the screen and reduces the service life of the screen.

The deposit is formed mainly out of three reasons:

1. Resin deposit. The resinous materials contained in the fine fraction act as an adhesive and cause a rather slow increase in the deposit. Increase in the deposit resulting from resin deposition always occurs when conifer chips are being screened.

2. Freezing. Occurs in particular in screening plants into which the chips are taken from heaps stored outdoors including the snow in winter. The increase in the deposit is often very rapid.

3. Paste formation. Like the former phenomenon, this one also takes place in particular in winter when chips that contain snow are screened. In the presence of a suitable moisture content, the fine wood dust forms a dough-like paste, whereby the deposit increases rapidly.

This problem has always existed, and it has required removal of the frozen deposits by means of hot water or steam as well as removal of the resinous deposits mechanically and by means of solvents.

Attempts have been made to prevent these problems, e.g., by means of teflon-coating of the bottom, by means of chains installed on the bottom, by coating the bottom with polyurethane, as well as by heating the bottom. None of the methods that have been tested eliminates the problems. Heating of the bottom by means of electricity is employed in practical operation. It melts the ice when the screen runs, but it does not prevent resin deposition.

SUMMARY AND OBJECTS OF THE PRESENT INVENTION

An object of the present invention is to eliminate the drawbacks mentioned above. The screen in accordance with the invention has a bottom face made of a flexible material and is displaceable during the screening relative to its support structure so that the bottom face is deformed.

Thus, the problem of deposition can be eliminated by making the bottom of the screen of a resilient material, e.g., of a rubber sheet, which keeps swinging during the operation of the screen like a carpet when it is shaken. The bottom is made trough-shaped, e.g., out of a rubber sheet which is fixed at its edges, and the lower end of the trough is provided with an opening for the removal of the wood dust. In the case of large screens or if the space taken by the operating gear of the screen so requires, it is advisable to make the bottom out of several troughs placed side by side. As the bottom face is deformed constantly during the screening, fine dust cannot adhere to it. In this way the screen bottom can be made self-cleaning.

BRIEF DESCRIPTION OF THE DRAWINGS

The invention and its details will be described in more detail in the following with reference to the accompanying drawings, wherein.

DETAILED DESCRIPTION OF THE PREFERRED EMBODIMENTS

Figure 1:
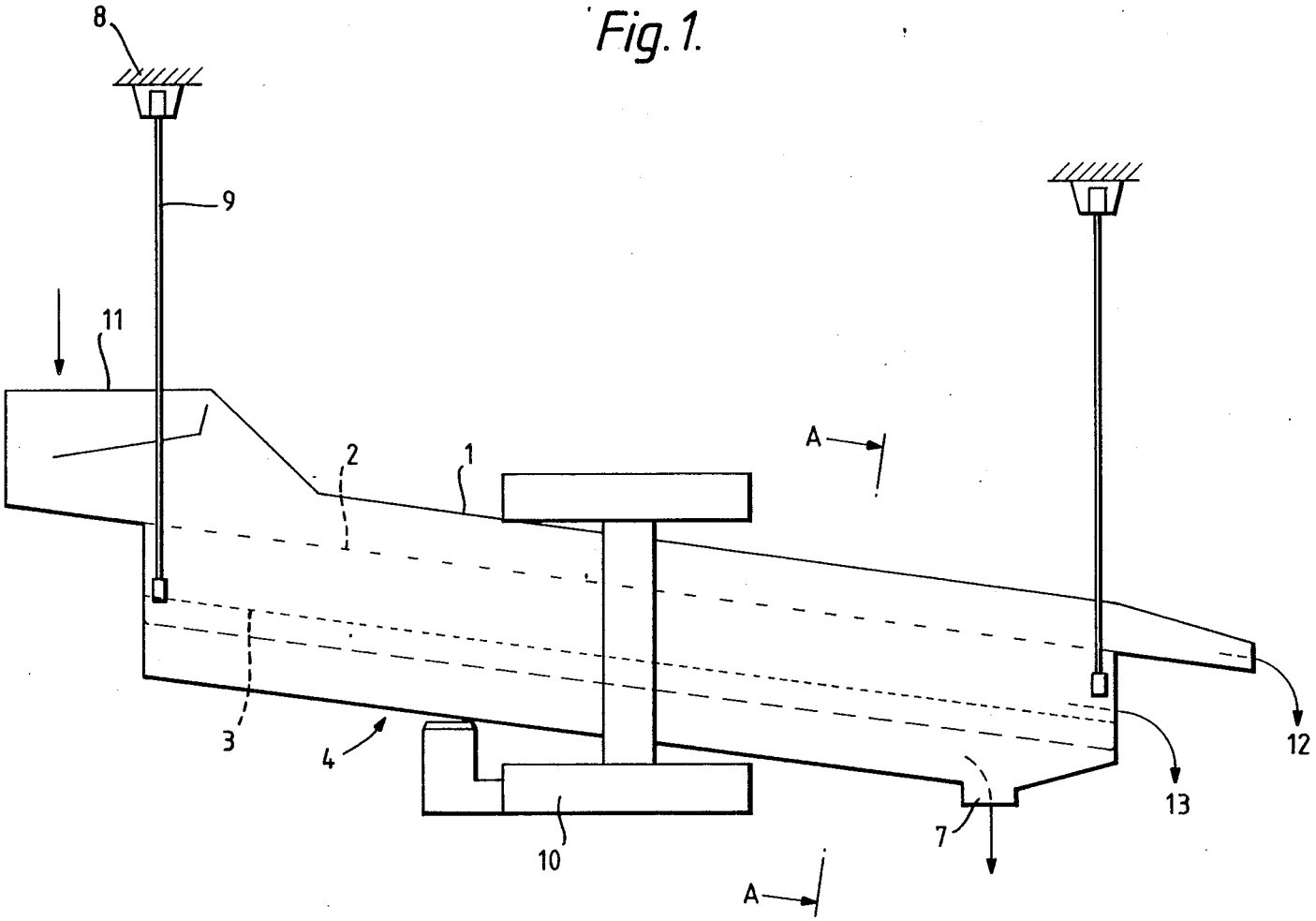
FIG. 1 is a schematic side view of a screen system in accordance with the invention.
Figure 2:
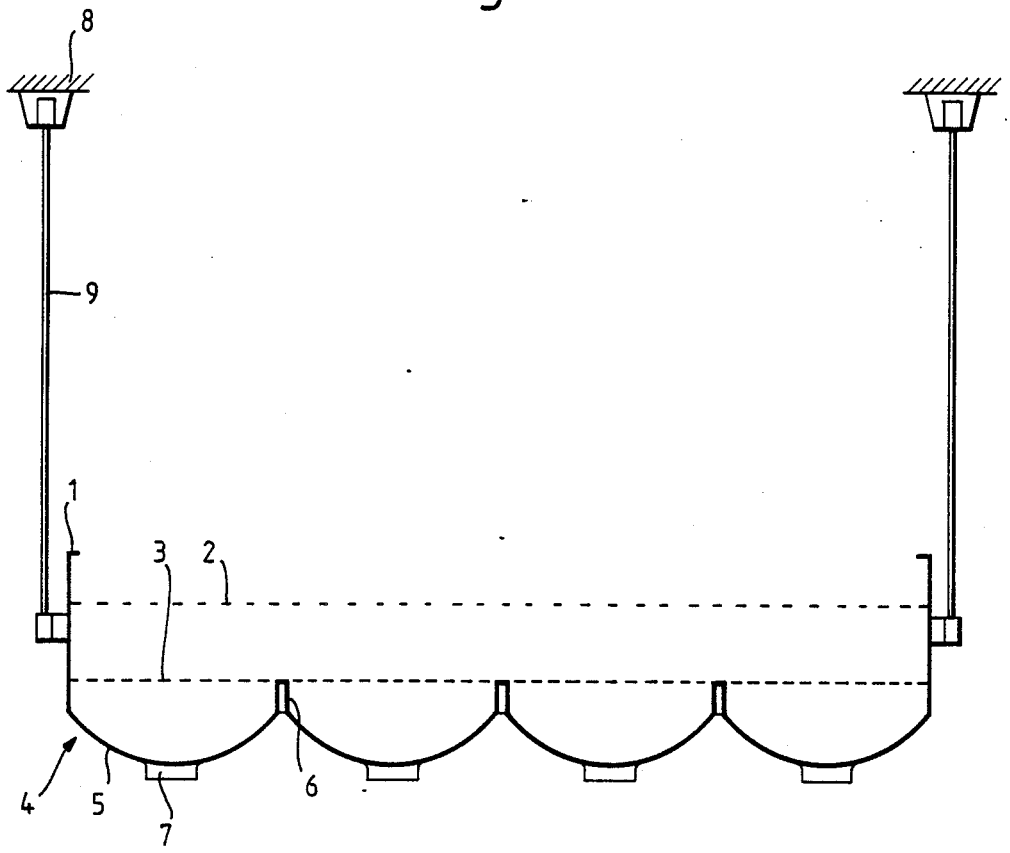
FIG. 2 shows a cross section taken along line A—A in FIG. 1.

The screen basket 1 is provided with two screen plates 2 and 3 placed one above the other and positioned inclined towards the outlet end for the material to be screened. The openings in the upper screen plate 2 are larger than those in the lower screen plate 3. Underneath the screen plates, there is a bottom face 4, which is solid and likewise inclined towards the outlet end.

The bottom face is made of flexible rubber sheets 5, which are fixed side by side to support rails 6 placed at the sides of each sheet. The rails are attached by their ends to the frame of the screen basket. The rubber sheets 5 are wider than the distance between two adjoining rails 6, whereby the rubber sheets hang down as trough-shaped. At the bottom ends of the troughs there are openings 7.

The screen basket is suspended on the support structure 8 placed above by means of four support ropes 9. Moreover, the screen is provided with an operating gear 10, by means of which the entire basket can be brought into a movement of vibration in a way in itself known. The feed point 11 is placed at the upper end of the screen.

The wood chips to be screened are fed at the feed point 11 onto the upper, coarse-meshed screen plate 2, which is supposed to catch any shives contained in the chips. The shives are removed at point 12. The rest of the chips pass through the plate 2 onto the plate 3, which holds the chips proper. These are removed at point 13. On the other hand, the dust fraction contained in the chips passes through both of the screen plates 2 and 3 and falls onto the bottom face 4 of the screen basket, from where it flows out through the outlet openings 7.

The operating gear 10 is operatively connected to the support rails 6 such that the vibration movement of the screen shakes the flexible rubber sheets of the troughs in the bottom face, whereby deposition of wood dust on them is prevented.

The invention is not restricted to the exemplifying embodiment described above alone, but it may show variation in different ways within the scope of the patent claims. For example, the screen basket 1 may be divided into several blocks placed one above the other, which said blocks move in relation to each other. The number of the screening faces placed one above the other may vary.

What is claimed is:

1. A screen system for the screening of wood chips, comprising:

a plurality of screening faces placed one above the other;

a bottom face having sides and a middle portion placed underneath said screening faces;

support means for supporting said bottom face;

vibrating means operatively connected to said screening faces for producing a screening movement;

the bottom face being made of a flexible material and is displaceable during the screening relative to its support means; and said support means being operatively connected to the vibrating means so that the support means are moved and the bottom face is deformed by the vibrating means during the screening movement whereby the adherence of materials on the bottom face is prevented.

2. The screen system as claimed in claim 1, wherein the width of the bottom face is larger than the distance between the support structures placed at the sides of the bottom face, whereby the middle portion of the bottom face is hanging down lower than its sides.

3. The screen system as claimed in claim 1, wherein the bottom face comprises at least two parts placed side by side, said support structures extend between the parts and at the sides of the parts, the width of each part is larger than the distance between the support structures placed at the sides of each of the parts, whereby the middle portion of the parts of the bottom face is hanging down lower than the sides of said parts.

* * * * *